US006247584B1

(12) United States Patent
Au

(10) Patent No.: US 6,247,584 B1
(45) Date of Patent: Jun. 19, 2001

(54) WEDDING DRESSED JEWELRY BOX

(76) Inventor: Ho Ching Au, Block A, 9/F, Goodview Inc. Building, 11 Kin Fat Street., N. T. Hong Kong (HK)

( * ) Notice: Subject to any disclaimer, the term of this patent is extended or adjusted under 35 U.S.C. 154(b) by 0 days.

(21) Appl. No.: 09/593,920

(22) Filed: Jun. 13, 2000

Related U.S. Application Data

(63) Continuation-in-part of application No. 09/227,798, filed on Jan. 9, 1999, now abandoned.

(51) Int. Cl.[7] ..... A45C 11/04

(52) U.S. Cl. ..... 206/6.1; 206/581; 190/124

(58) Field of Search ..... 206/6.1, 581, 223, 206/566; 190/106, 109, 115, 116, 117, 119, 121, 124, 125, 127

(56) References Cited

U.S. PATENT DOCUMENTS

| | | | | |
|---|---|---|---|---|
| 830,577 | * | 9/1906 | Devine | 190/124 |
| 2,509,370 | * | 5/1950 | Rubin | 190/124 |
| 3,042,192 | * | 7/1962 | Herrin | 206/1.6 |
| 4,561,525 | * | 12/1985 | Shidner | 190/106 |
| 5,265,719 | * | 11/1993 | Wand | 206/223 |

* cited by examiner

*Primary Examiner*—Paul T. Sewell
*Assistant Examiner*—Shian Luong
(74) *Attorney, Agent, or Firm*—Raymond Y. Chan; David and Raymond Patent Firm

(57) ABSTRACT

A wedding dressed jewelry box enables wedding gauze and/or lace to perfectly wrap to the jewelry box, by wrapping the base box and the box cover of the jewelry box with dressing sheet. The dressing sheet includes a wedding gauze layer having peripheral edges sewn and/or adhered around a lining layer to form the dressing sheet. Therefore, by directly adhering the lining layer to the exterior and outer surfaces of the base boxes and the box cover can firmly wrap the dressing gauze layer to the jewelry box.

9 Claims, 6 Drawing Sheets

WEDDING DRESSED JEWELRY BOX

CROSS REFERENCE OF RELATED APPLICATION

This is a continuation-in-part application of a non-provisional application having an application of 09/227,798 and a filing date of Jan. 9, 1999 now abandoned.

BACKGROUND OF THE PRESENT INVENTION

1. Field of Invention

The present invention relates to a jewelry box, and more particularly to a wedding dressed jewelry box for wedding ceremony that can provide a valuable, elegant and graceful wedding jewelry box with simple and novel structure and wonderful display effect compared with the arts.

2. Description of Related Arts

Nowadays, the jewelry boxes have different grades for various gifts. Everyone wants to obtain satisfactory wedding jewelry gifts containing in jewelry boxes because there is special meaning, especially the gift between the groom and the bride. The paired watches, paired rings and necklaces seem to be absolutely necessary. Furthermore, the conventional jewelry box lacks jubilant atmosphere.

SUMMARY OF THE PRESENT INVENTION

A main objective of the present invention is to provide a wedding dressed jewelry box which enables wedding gauze and/or lace to perfectly wrap to the jewelry box, so as to provide elegant and wonderful decorative effect corresponding, to the jubilant atmosphere of wedding ceremony.

Another objective of the present invention is to provide a wedding dressed jewelry box having an inner pad which is also firmly wrapped with wedding gauze or lace for mounting watch or necklace thereon.

In order to accomplish the above objectives, the present invention provides a wedding dressed jewelry box which comprises:

- a base box having an interior surface and an exterior surface, wherein the base box has a receiving chamber provided therein and an opening communicating the receiving chamber with outside;
- a box cover, having an inner surface and an outer surface, for covering the opening of the base box;
- a first dressing sheet having a surface area larger than a surface area of the exterior surface of the base box; and
- a second dressing sheet having a surface area larger than a surface area of the outer surface of the box cover;
- each of the first and second dressing sheets comprising a lining layer and a wedding gauze layer which is overlapped on the lining layer with peripheral edges thereof connected around the lining layer to form a peripheral border,
- wherein the first dressing sheet is wrapped to the base box by attaching the lining layer of the first dressing sheet to the exterior surface until the peripheral border of the first dressing sheet is inwardly extended to attach on the interior surface of the base box,
- wherein the second dressing sheet is wrapped to the box cover by attaching the lining layer of the second dressing sheet to the outer surface until the peripheral border of the second dressing sheet is inwardly extended to attach on the inner surface of the box cover.

DETAILED DESCRIPTION OF THE PREFERRED EMBODIMENT

Figure 1:
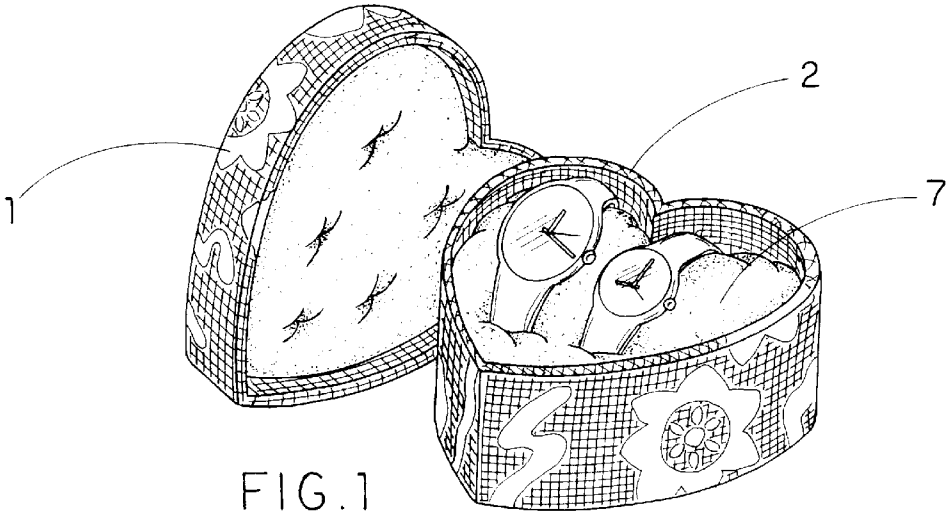
FIG. 1 is an exploded perspective view of the wedding dressed jewelry box in form of single-heart (for placing a pair of watches) with wedding gauze-wrapped and buckled type.
Figure 2:
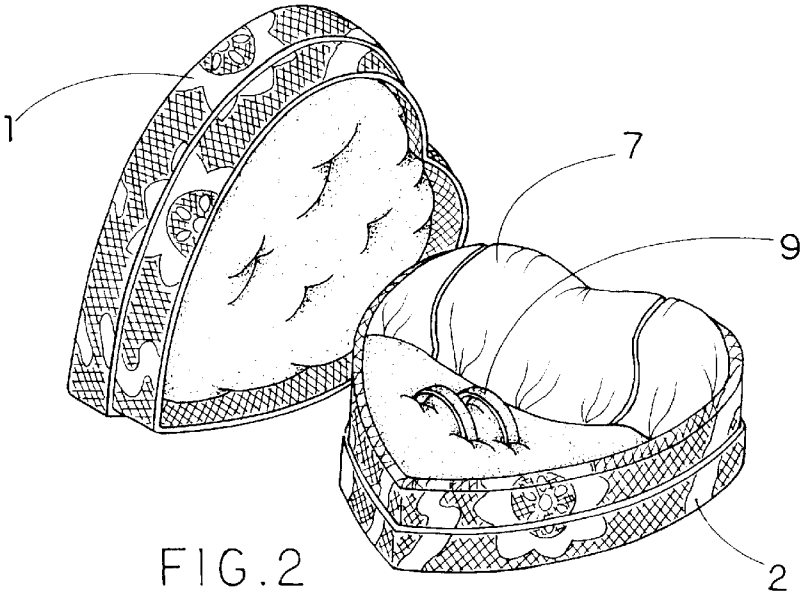
FIG. 2 is an exploded perspective view of the wedding dressed jewelry box in form of single-heart (for placing a pair of rings and necklaces) with wedding gauze-wrapped and buckled type.
Figure 3:
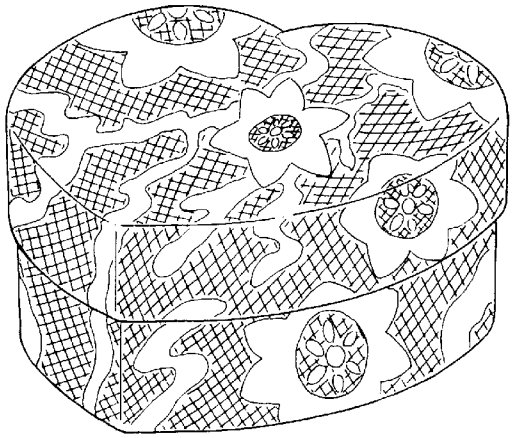
FIG. 3 is an elevation view of the external form of the wedding dressed jewelry box in form of single-heart (wrapped with wedding gauze) with wedding gauze-wrapped band buckled type.
Figure 4:
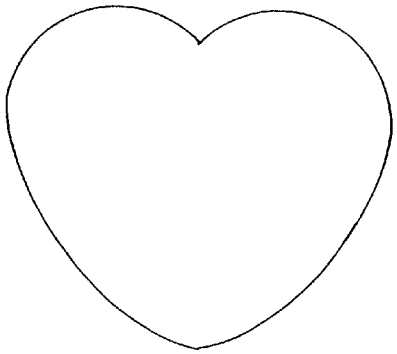
FIG. 4. is a top view of the buckled type wedding dressed jewelry box in form of single-heart, before wrapping.
Figure 5:
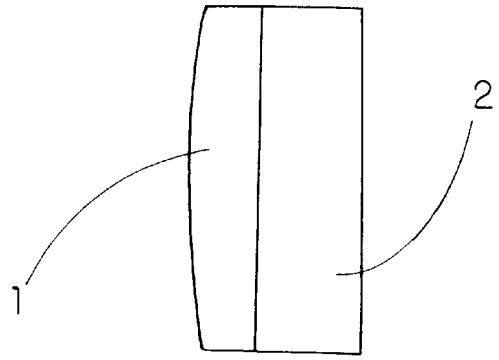
FIG. 5 is a side view of the buckled type wedding dressed jewelry box as shown in FIG. 4, before wrapping.
Figure 6:
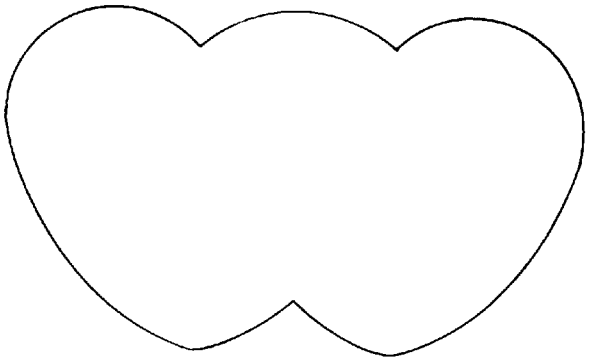
FIG. 6 is a top view of the buckled type wedding dressed jewelry box in form of double-heart, before wrapping.
Figure 7:
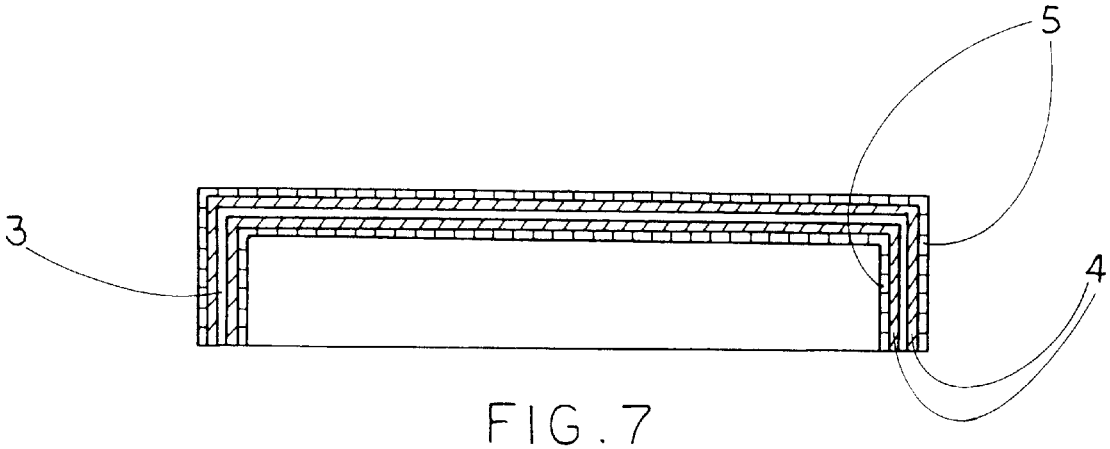
FIG. 7 is a sectional view of the layer structure of the box cover.
Figure 9:
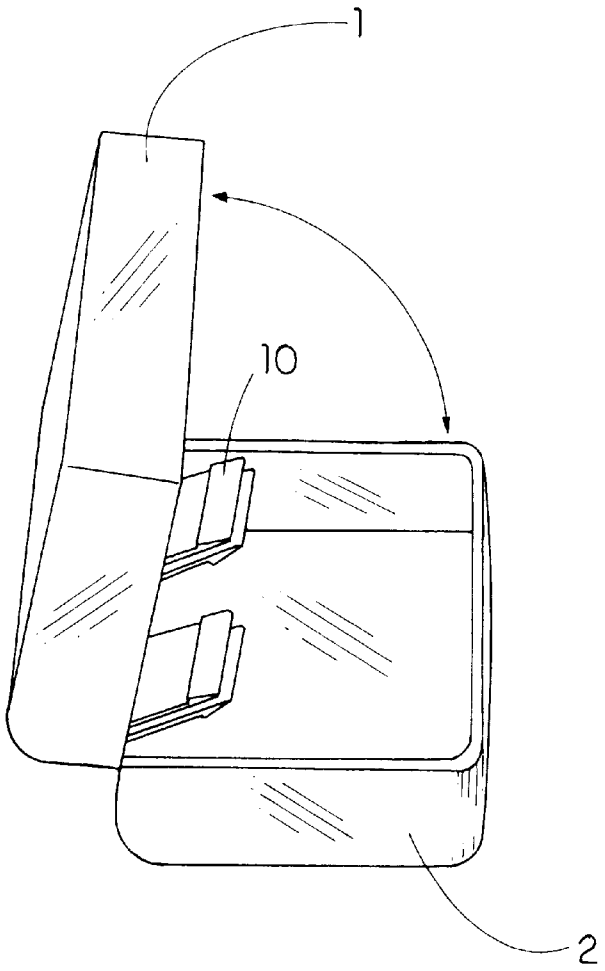
FIG. 9 is a perspective view of another rectangular-shaped and hinge-jointed jewelry ring pack, before wrapping.
Figure 8:
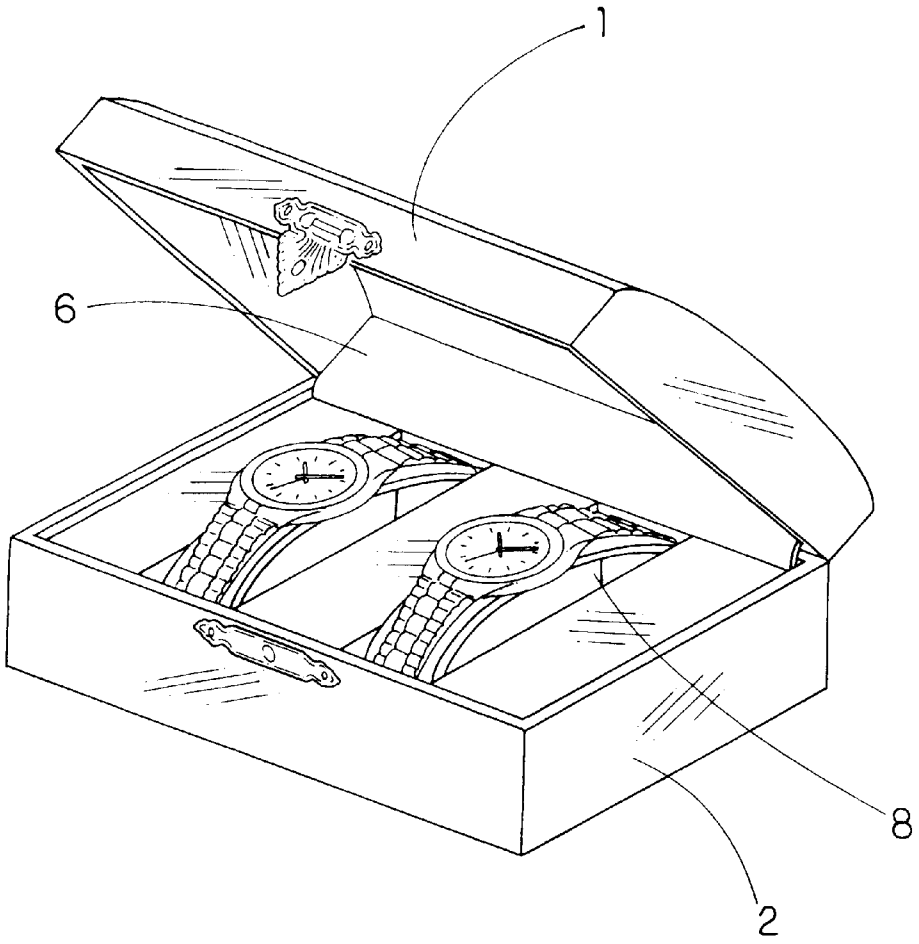
FIG. 8 is a perspective view of a rectangular-shaped and hinge-jointed jewelry watch pack, before wrapping.

The present invention relates to a wedding dressed jewelry box which comprises a box cover 1 and a base box 2 with an inner pad 7. The jewelry box is wrapped with leather, paper or composite material, wherein the inside or the outside or both the inside and the outside of the box cover 1 and the base box 2 are wrapped with wedding gauze (as shown in FIGS. 1, 2 and 3). The inside of the box has an inner pad 7 or slots 8 or racks for placing wrist watch and slots 9 or clips 10 for placing jewels. The outer surface of the inner pad is wrapped with wedding gauze (as shown in FIG. 1). The box cover 1 and the base box 2 are generally heart-shaped (single-heart or double-heart) (as shown in FIGS. 4, 5 and 6), rectangular-shaped (as shown in FIGS. 8 and 9) or spherical-shaped. The box cover 1 is buckled onto the base box 2 (as shown in FIG. 1) or jointed by hinge (as shown in FIGS. 8 and 9). The inside of the jewelry box comprising the box cover 1 and the base box 2, has an inner pad 7 or racks for placing wrist watch or board for placing jewels, in order to place a pair of watches, necklaces, rings or other noble gifts. The jewelry box in form of heart-shape consists of box cover and the base box for placing necklace and paired-rings. The inner pad 7 for placing the necklace is in the rear portion whereas the slot 8 for placing the pair of wedding rings in the front portion, namely, the tip of the heart-shape. The base 3 of the box cover 2 and base box is made of plastic sheet or chipboard. The outside of the base 3 is wrapped with leather, paper or composite material 4 and then wrapped with wedding gauze 5 (as shown in FIG. 7).

Figure 10:
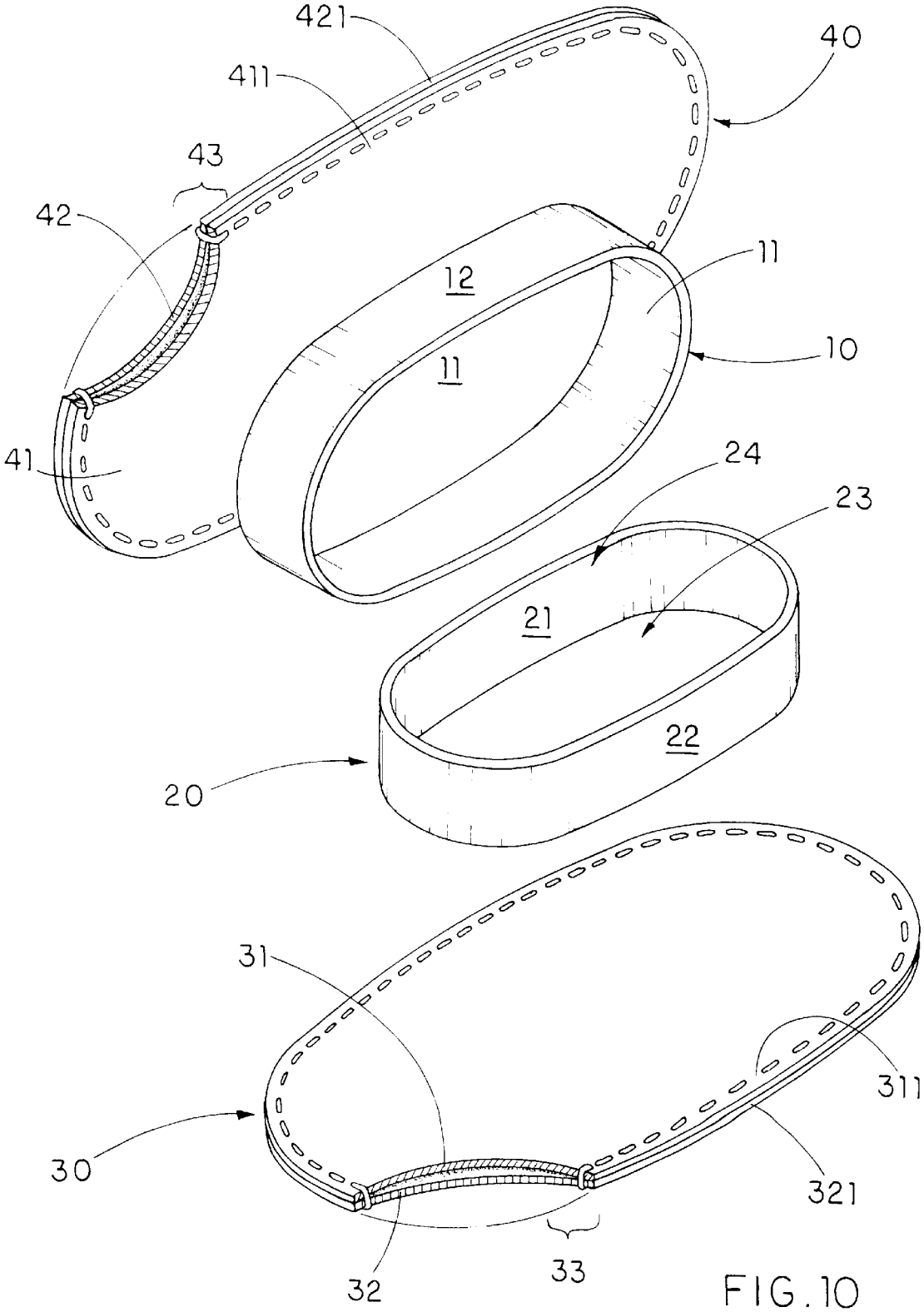
FIG. 10 is an exploded perspective view of the base box, the box cover and the first and second wedding sheets of a wedding dressed jewelry box according to a preferred embodiment of the present invention.
Figure 11:
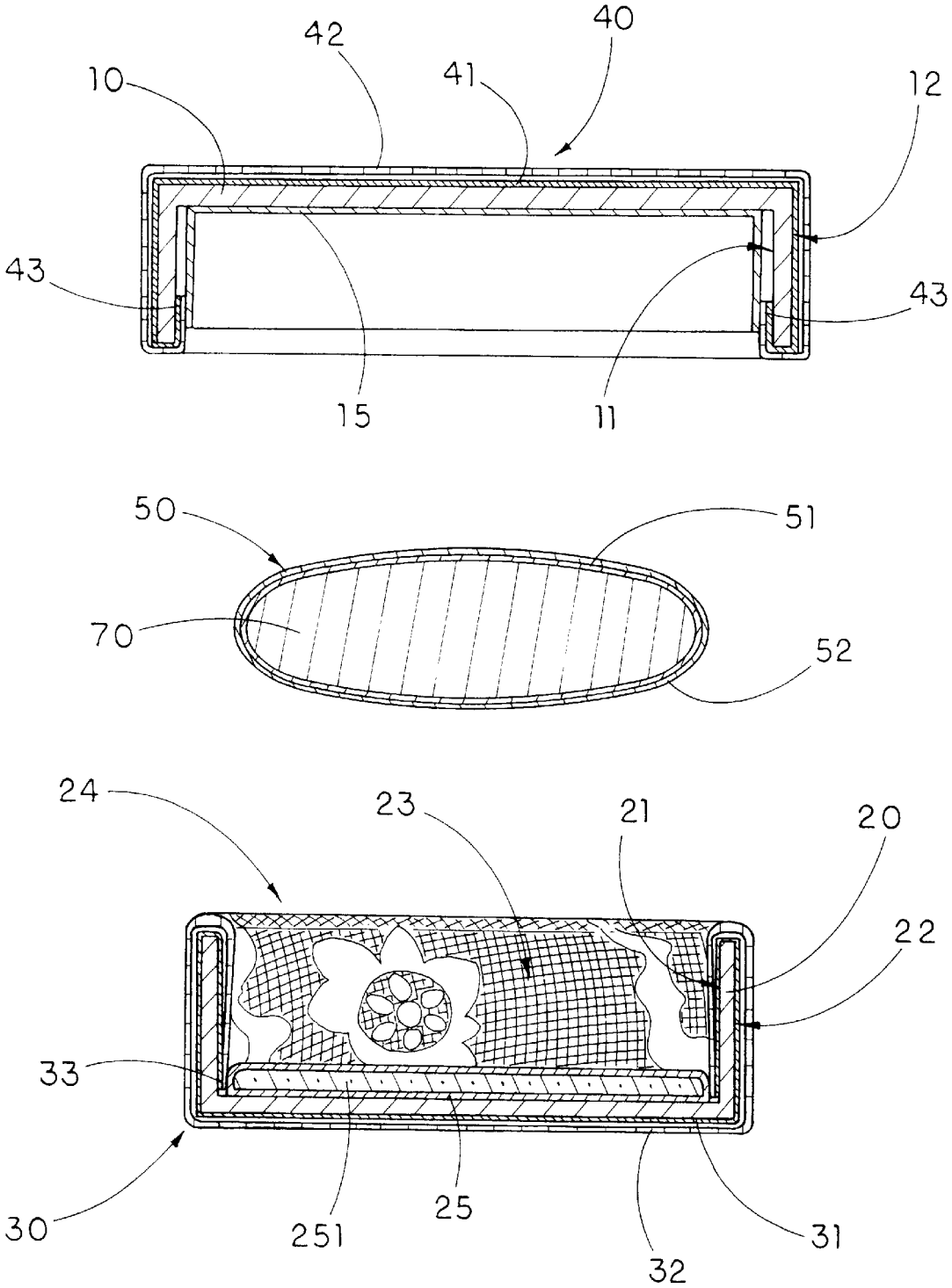
FIG. 11 is a sectional view of the wedding dress jewelry box according to the above preferred embodiment of the present invention.

Referring to FIGS. 10 and 11, a wedding dressed jewelry box according to a preferred embodiment of the present invention is illustrated, which comprises a base box 20 and a box cover 10.

The base box 20 has an interior surface 21 and an exterior surface 22. The base box 20 further has a receiving chamber 23 provided therein and an opening 24 communicating the receiving chamber 23 with outside. The box cover 10, having an inner surface 11 and an outer surface 12, is adapted for covering the opening 24 of the base box 20.

The wedding dressed jewelry box of the present invention further comprises a first dressing sheet 30 having a surface area larger than a surface area of the exterior surface 22 of the base box 20, and a second dressing sheet 40 having a surface area larger than a surface area of the outer surface 12 of the box cover 10.

Each of the first and second dressing sheets 30, 40 comprises a lining layer 31, 41 and a wedding gauze layer 32, 42 which is overlapped on the lining layer 31, 41 with peripheral edges 321, 421 thereof connected around the circumferential edges 311, 411 the lining layer 31, 41 to form a peripheral border 33, 43. The lining layers 31, 41 can be made of leather, paper, fabric, cloth, or composite materials. The wedding gauze layers 32, 42 can be made of wedding lace.

As shown in FIG. 10, the peripheral edges 321, 421 of the wedding gauze layers 32, 42 are sewn to the circumferential edges 311, 411 of the lining layers 31, 41 respectively. Certainly, the peripheral edges 321, 421 of the wedding gauze layers 32, 42 may also simply adhere to the circumferential edges 311, 411 of the lining layers 31, 41. Accordingly, both the lining layer 31, 41 and the wedding gauze layer 32, 42 are connected together at the peripheral border 33, 43 while the rest central portions of the lining layer 31, 41 and the wedding gauze layer 32, 42 within the peripheral border 33, 43 remain non-attaching and be simply overlapping, so as to maintain the ornamental appearance of the lace material.

According to the preferred embodiment of the present invention, as shown in FIGS. 10 and 11, the first dressing sheet 30 is wrapped to the base box 20 by attaching the lining layer 31 of the first dressing sheet 30 to the exterior surface 22 until the peripheral border 33 of the first dressing sheet 30 is inwardly extended to attach on the interior surface 21 of the base box 20.

Similarly, the second dressing sheet 40 is wrapped to the box cover 10 by attaching the lining layer 41 of the second dressing sheet 40 to the outer surface 12 until the peripheral border 43 of the second dressing sheet 40 is inwardly extended to attach on the inner surface 11 of the box cover 10.

In order to cover the peripheral borders 33 and 43 of first and second dressing sheets 30, 40, a base box interior support member 25 wrapped with cushion pad 251 therein is preferred to dispose on the bottom of the receiving chamber 23 of the base box to cover the peripheral border 33 and support the jewelry to be contained in the receiving chamber 23, as shown in FIG. 11. Also, an interior cover member 15 is preferred to cover the inner surface 11 of the box cover 10 so as to shelter the peripheral border 43 of the second dressing sheet 40.

As shown in FIG. 11, the wedding dressed jewelry box of the present invention can further comprises an inner pad 70 which is also wrapped with a third dressing sheet 50. Similar to the first and second dressing sheets 30, 40, the third dressing sheet 50 also comprises a lining layer 51 and a wedding gauze layer 52 which is overlapped on the lining layer 51 with peripheral edges thereof connected around the circumferential edges the lining layer. The lining layers 51 can also be made of leather, paper, fabric, cloth, or composite materials. The wedding gauze layers 52 can also be made of wedding lace.

Figure 12:
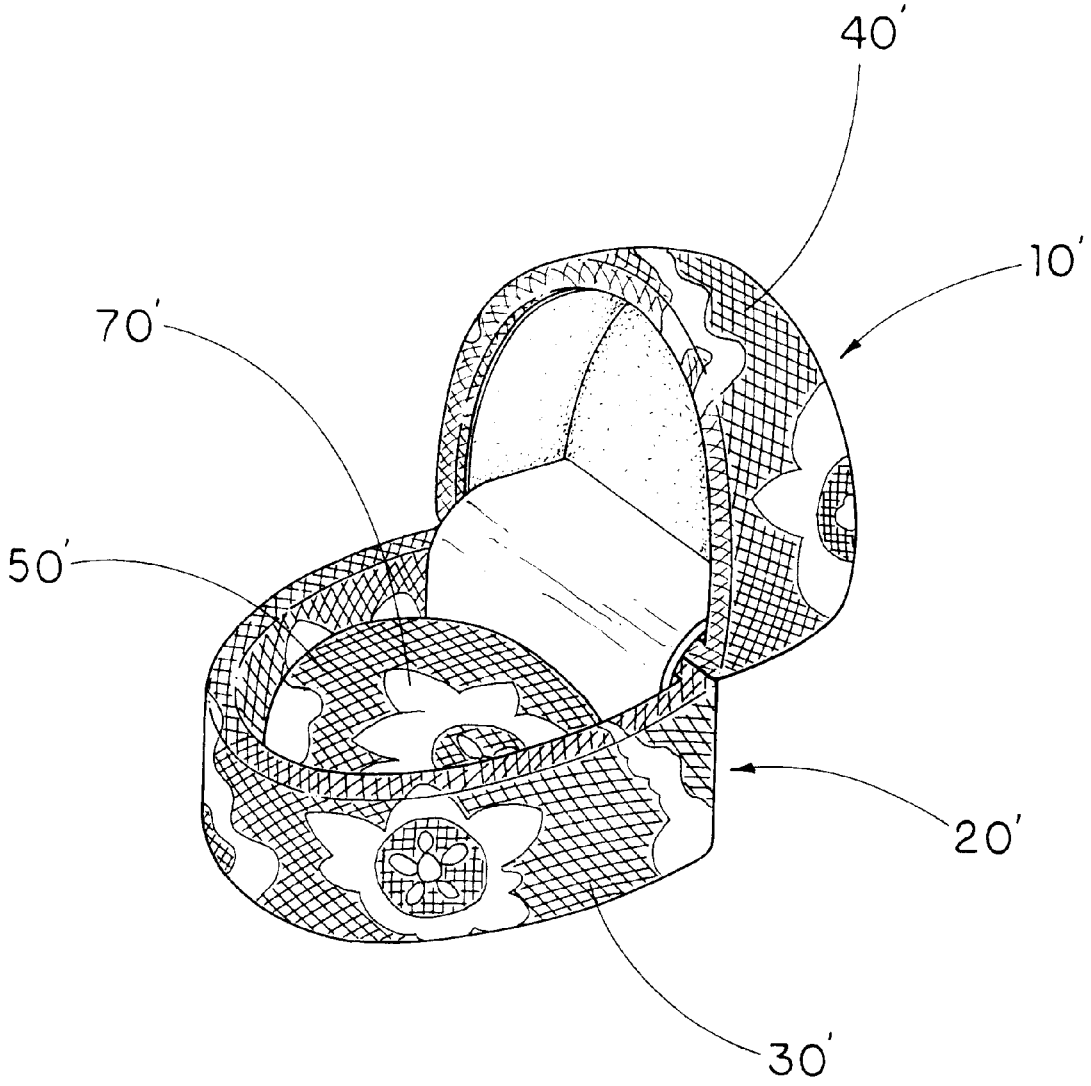
FIG. 12 is a perspective view of an alternative mode of the wedding dress jewelry box of the present invention.

Referring to FIG. 12, an alternative mode of the wedding dressed jewelry box is illustrated, which base box 20' has one side hinged with the box cover 10'. Also, the exterior surface of the base box 20' as well as the outer surface of the box cover 10' are all wrapped with dressing sheets 30', 40' constructed as disclosed above. The inner pad 70' disposed in the base box 20 is also wrapped with dressing sheet 50'.

In view of above, the wedding dressed jewelry box of the present invention enables wedding gauze and/or lace to perfectly wrap to the jewelry box without damaging the soft, thin and weak lace material, so as to provide elegant and wonderful decorative effect corresponding to the jubilant atmosphere of wedding ceremony.

What is claimed is:

1. A wedding dressed jewelry box, comprising:

a base box having an interior surface and an exterior surface, wherein said base box has a receiving chamber provided therein and an opening communicating said receiving chamber with outside;

a box cover, having an inner surface and an outer surface, for covering said opening of said base box;

a first dressing sheet having a surface area larger than a surface area of said exterior surface of said base box; and a second dressing sheet having a surface area larger than a surface area of said outer surface of said box cover;

each of said first and second dressing sheets comprising a lining layer and a wedding gauze layer which is overlapped on said lining layer with peripheral edges thereof connected around said lining layer to form a peripheral border, wherein said first dressing sheet is wrapped to said base box by attaching said lining layer of said first dressing sheet to said exterior surface until said peripheral border of said first dressing sheet is inwardly extended to attach on said interior surface of said base box, wherein said second dressing sheet is wrapped to said box cover by attaching said lining layer of said second dressing sheet to said outer surface until said peripheral border of said second dressing sheet is inwardly extended to attach on said inner surface of said box cover.

2. A wedding dressed jewelry box, as recited in claim 1, wherein said peripheral edges of said first and second wedding gauze layers are sewn to said circumferential edges of said first and second lining layers respectively.

3. A wedding dressed jewelry box, as recited in claim 2, wherein central portions of said lining layer and said wedding gauze layer within said peripheral border remain overlapping separately.

4. A wedding dressed jewelry box, as recited in claim 1, further comprises a base box interior support member wrapped with cushion pad therein, which is disposed in said receiving chamber of said base box to cover said peripheral border.

5. A wedding dressed jewelry box, as recited in claim 2, further comprises a base box interior support member wrapped with cushion pad therein, which is disposed in said receiving chamber of said base box to cover said peripheral border.

6. A wedding dressed jewelry box, as recited in claim 3, further comprises a base box interior support member wrapped with cushion pad therein, which is disposed in said receiving chamber of said base box to cover said peripheral border.

7. A wedding dressed jewelry box, as recited in claim 4, further comprising an interior cover member which is disposed in said box cover to cover said inner surface of said box cover so as to shelter said peripheral border of said second dressing sheet.

8. A wedding dressed jewelry box, as recited in claim 5, further comprising an interior cover member which is disposed in said box cover to cover said inner surface of said box cover so as to shelter said peripheral border of said second dressing sheet.

9. A wedding dressed jewelry box, as recited in claim 6, further comprising an interior cover member which is disposed in said box cover to cover said inner surface of said box cover so as to shelter said peripheral border of said second dressing sheet.

* * * * *